US005875492A

United States Patent [19]

Moss

[11] Patent Number: 5,875,492

[45] Date of Patent: Mar. 2, 1999

[54] WATER-RESISTANT COMBINATION BLANKET AND COAT

[76] Inventor: Jennifer E. Moss, 2726 Summer La., Eugene, Oreg. 97404

[21] Appl. No.: 970,708

[22] Filed: Nov. 14, 1997

[51] Int. Cl.[6] ..... A41D 1/00

[52] U.S. Cl. ..... 2/93; 2/84; 2/82; 2/85; 2/87

[58] Field of Search ..... 2/69, 69.5, 88, 2/102, 115, 108, 85, 93, 87, 94, 95, 82, 84, 114

[56] References Cited

U.S. PATENT DOCUMENTS

| | | | |
|---|---|---|---|
| 1,496,283 | 6/1924 | Wright | 2/69 |
| 1,509,296 | 9/1924 | Hopewell | 2/69 |
| 1,610,799 | 12/1926 | Lack et al | 2/69 |
| 1,641,039 | 8/1927 | La Beaud | 2/69 |
| 2,372,110 | 3/1945 | Noone | 2/87 |
| 3,522,612 | 8/1970 | Palmer | 2/88 |
| 3,590,864 | 7/1971 | Vechesloff | 2/69 X |
| 4,240,159 | 12/1980 | Wrightson | 2/69 X |
| 4,484,362 | 11/1984 | Asher | 2/69 |
| 4,541,128 | 9/1985 | Will et al. | 2/84 |

*Primary Examiner*—Gloria M. Hale
*Attorney, Agent, or Firm*—David S. Alavi

[57] ABSTRACT

A water-resistant combination blanket and coat is disclosed comprising a fabric sheet having a water-resistant outer surface. The fabric sheet may be spread on the ground as a blanket with the water-resistant outer surface down, thereby providing a place for a user to sit, even on wet, dirty, and/or muddy ground. Two points on the top edge of the fabric sheet may be reversibly connected to the right and left edges, thereby forming sleeves. A user may use the fabric sheet as a coat by placing his/her arms through the sleeves and wrapping the fabric sheet around him/herself. Reversibly connecting two points along the top edge of the fabric sheet to each other may further provide a hood while the fabric sheet is used as a coat. Alternatively, a detachable hood may be reversibly connected to the top edge of the fabric sheet while the fabric sheet is used as a coat. The detachable hood may comprise a pocket with two adjacent open sides. One open side may be pulled apart and reversibly connected to the top edge of the fabric sheet in a linear fashion, thereby forming a hood. The detachable hood may also function as a storage bag for the combination blanket and coat. The combination blanket and coat may be placed within the pocket and the two open sides reversibly closed to enclose the combination blanket and coat.

21 Claims, 5 Drawing Sheets

WATER-RESISTANT COMBINATION BLANKET AND COAT

FIELD OF THE INVENTION

The field of the present invention relates to water-resistant blankets and coats. In particular, apparatus and methods are described herein for use outdoors as a water-resistant coat or as a water-resistant blanket.

BACKGROUND

The growth of organized youth sports in America has been phenomenal. Each year millions of children participate in a variety of organized youth programs in a variety of sports, both indoor and outdoor. Parental involvement, particularly attendance at games, is a key positive aspect of these youth sports programs. Many of the outdoors sports are played on fields in municipal parks or at public schools. For the most part, such playing fields provide only the most rudimentary facilities for playing the game, and are not designed for the comfort of spectators. Seating is rarely provided, and if provided is exposed to the elements. Often the only access to a playing field is by walking across one or more other fields, making it difficult to bring along seating, such as a folding chair or the like. Sitting on the ground is frequently not an option, since fields are often wet, dirty, and/or muddy. It is therefore common to find groups of parents and/or spectators simply standing along the sidelines for the entire length of a game. Depending on the sport and age level of the participants, this may result in several hours of standing, a tiring and uncomfortable proposition at best. Depending on the season of the year, the temperature may be below the comfort level of the parents/spectators. In some cases games may be played in spite of inclement weather.

As described above, carrying one's own seating to a remote playing field may be problematic. Sitting on wet, dirty, and/or muddy ground may result in wet and/or soiled clothing. Cold and/or inclement weather may necessitate the wearing of bulky garments, making it even more difficult to carry seating over a substantial distance.

It is therefore desirable to provide a combination blanket and coat which: allows a user to keep warm and dry in inclement weather, allows a user to sit on wet and/or muddy ground without becoming wet and/or dirty, is light-weight and convenient to carry, may be worn as a coat, and may be spread on the ground as a blanket. Such a combination blanket and coat should preferably be readily and quickly convertible from a blanket to a coat and back again, allowing maximum flexibility to respond to rapidly changing weather conditions. The combination blanket and coat would also be useful in other situations, including but not limited to: outdoor concerts, hunting, outdoor spectator sporting events, swimming outdoors in cool weather, or as an emergency accessory for an automobile. In the latter situation, the combination blanket and coat may be used on the ground while a motorist attempts to effect repairs under a disabled vehicle, or worn by the motorist while waiting for assistance in cold weather.

SUMMARY

Certain aspects of the present invention may overcome one or more aforementioned drawbacks of the previous art and/or advance the state-of-the-art of blankets and coats, and in addition may meet one or more of the following objects:

To provide a water-resistant combination blanket and coat which may be worn by a user as a water-resistant coat;

To provide a water-resistant combination blanket and coat which may be spread on the ground as a water-resistant blanket;

To provide a method for converting a combination blanket and coat from a coat to a blanket and back again;

To provide a water-resistant combination blanket and coat which has a hood;

To provide a water-resistant combination blanket and coat which has a detachable hood which may be used as a storage bag for the combination blanket and coat;

To provide methods for converting the detachable hood to a storage bag, storing the combination blanket and coat in the storage bag, and converting the storage bag into the hood; and To provide a water-resistant combination blanket and coat which may be used to display advertising indicia.

One or more of the foregoing objects may be achieved in the present invention by a water-resistant combination blanket and coat comprising a fabric sheet having a substantially water-resistant outer surface. The fabric sheet may be spread on the ground as a blanket with the water-resistant outer surface down, thereby providing a place for a user to sit without becoming wet or dirty, even on wet, dirty, and/or muddy ground. A point on a top edge of the fabric sheet may be reversibly connected to a right edge, thereby forming a right sleeve, and a point on the top edge of the fabric sheet may be reversibly connected to a left edge, thereby forming a left sleeve. A user may use the fabric sheet as a coat by placing his/her arms through the sleeves and wrapping the fabric sheet around him/herself. The fabric sheet may therefore serve as either a coat or a blanket, depending on whether the top edge is connected to the right and left edges. Reversibly connecting two points along the top edge of the fabric sheet to each other may further provide a hood while the fabric sheet is used as a coat.

The combination blanket and coat may be further provided with a detachable hood which may be reversibly connected to the top edge of the fabric sheet while the fabric sheet is used as a coat. The detachable hood may comprise a pocket with two adjacent open sides. One open side may be pulled apart and reversibly connected to the top edge of the fabric sheet in a linear fashion, thereby forming a hood. The detachable hood may also function as a storage bag for the combination blanket and coat. The combination blanket and coat may be placed within the pocket and the two open sides reversibly closed to enclose the combination blanket and coat.

Additional objects and advantages of the present invention may become apparent upon referring to the preferred and alternative embodiments of the present invention as illustrated in the drawings and described in the following written description and/or claims.

DETAILED DESCRIPTION OF PREFERRED AND ALTERNATIVE EMBODIMENTS

For purposes of the present written description and/or claims, "reversibly connected", "reversibly disconnected", "reversibly closed", "reversibly opened", and the like shall denote connections and/or closures between two or more components which may be made and broken repeatedly in the course of use of the combination blanket and coat according to the present invention. For example, as set forth hereinbelow, reversible connections between edges of the combination blanket and coat must be made when converting from a blanket to a coat, and these connection must be broken when converting from a coat back to a blanket. Such conversions are intended to be repeated many times, therefore the reversible connection must be made and broken repeatedly. Examples of fasteners suitable for making such reversible connections and/or closures include but are not limited to: snaps, buttons, zippers, hooks, tabs and slots, buckles, drawstrings, laces, thongs, ropes, strings, cords, grommets, hook and loop type fasteners (i.e., Velcro®), pressed-fit connectors, combinations thereof, and/or functional equivalents thereof. The foregoing list is exemplary, and shall not be construed as limiting the scope of inventive concepts disclosed and/or claimed herein.

Figures 1, 2:
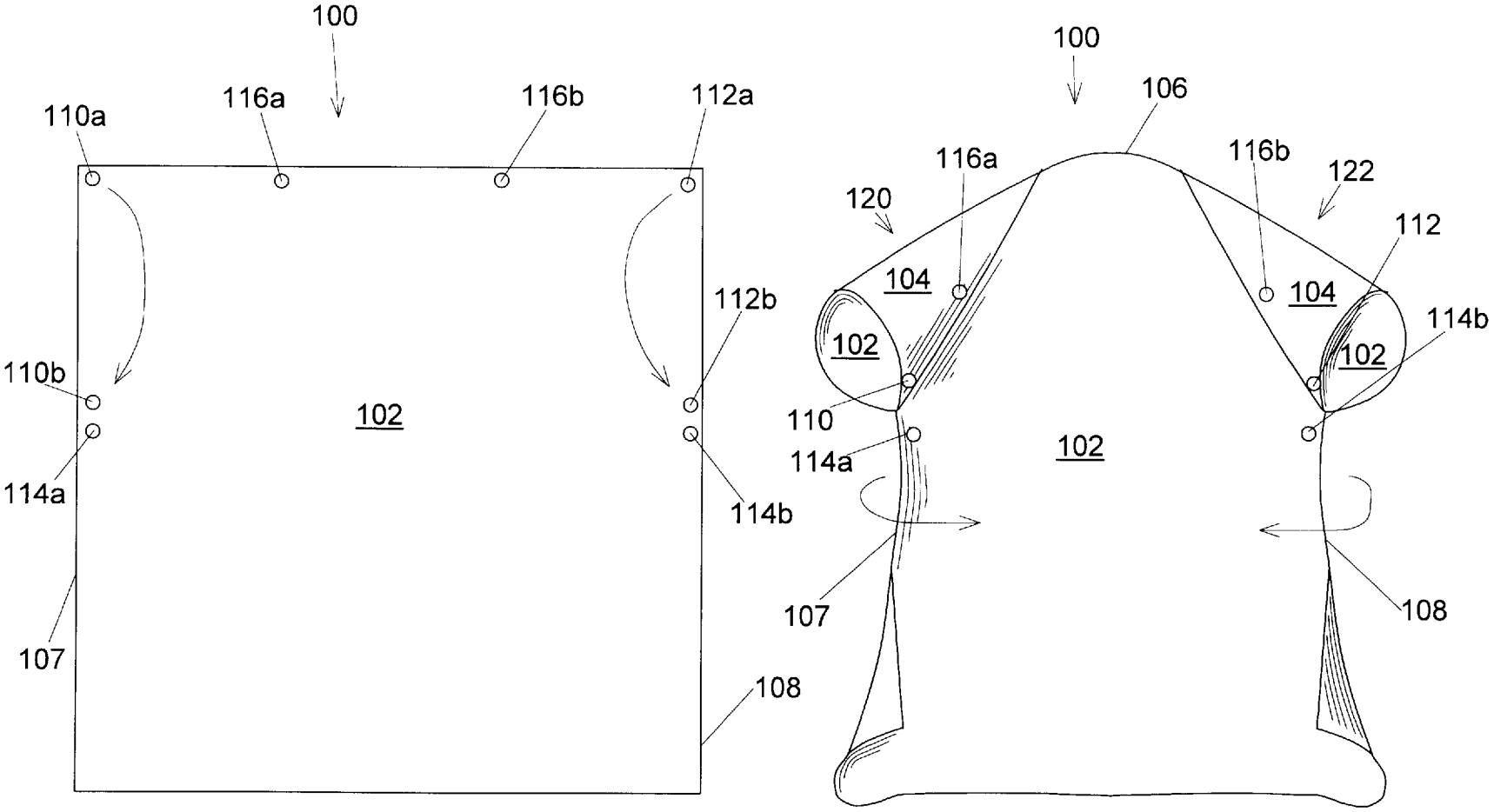
FIG. 1 shows a combination blanket and coat according to the present invention while spread out as a blanket.
FIG. 2 shows a combination blanket and coat according to the present invention as it is converted from a blanket to a coat.

FIGS. 1 through 4 show a preferred embodiment of a combination blanket and coat according to the present invention, and also illustrate preferred methods for converting a combination blanket and coat according to the present invention from a blanket to a coat and back again. Combination blanket and coat 100 is shown spread as a blanket in FIG. 1, and comprises a substantially rectangular fabric sheet. Without departing from inventive concepts disclose and/or claimed herein, any suitable shape may be employed for the fabric sheet. Inner surface 102 is shown in FIG. 1, while substantially water-resistant outer surface 104 is not visible in FIG. 1. Water-resistant outer surface 104 may comprise any water-resistant fabric, including but not limited to: nylon, pack cloth, canvas, Gortex®, vinyl, polymer-impregnated fabrics, laminated fabrics, plastics, rubberized fabrics, synthetic fabrics, combinations thereof, and/or functional equivalents thereof. Inner surface 102 may comprise a water-resistant fabric as recited hereinabove, or may comprise, for example, fleece, Polartech®, wool, flannel, or any other suitable fabric or cloth. The two foregoing lists are exemplary, and shall not be construed as limiting the scope of inventive concepts disclosed and/or claimed herein. Insulating material may be provided between the outer and inner surfaces, which may be held together by any of a variety of means known in the art. Fasteners 110, 112, 114, and 116 are provided along edges 106, 107, and 108 of the fabric sheet for reversibly connecting various portions of the fabric sheet together when it is used as a coat, as described hereinbelow. With water-resistant outer surface 104 against the ground, a user may sit on the ground on combination blanket and coat 100 and be protected from wet and/or muddy ground.

Figure 4:
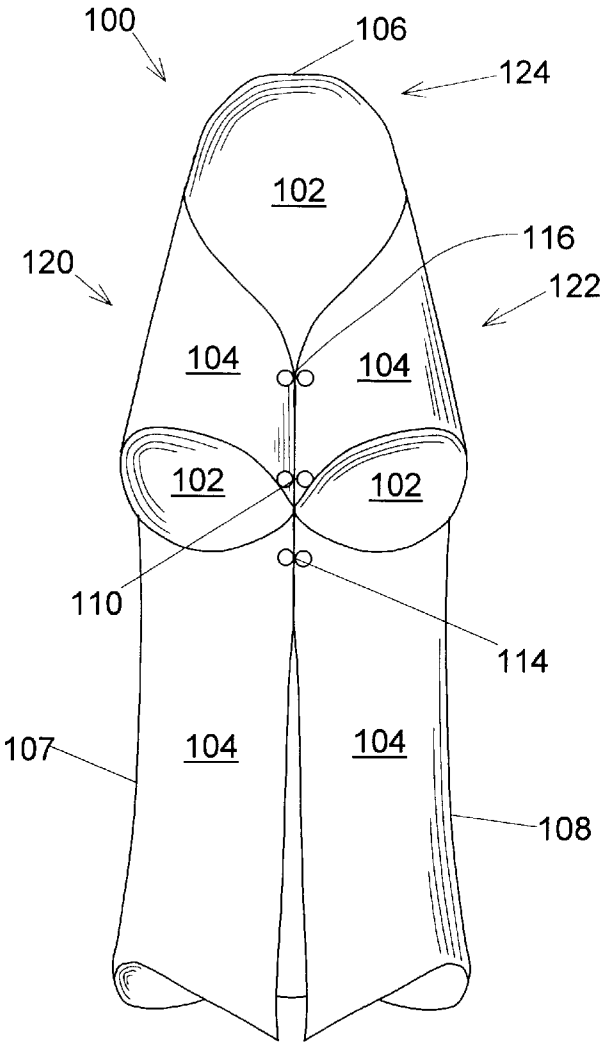
FIG. 4 shows a combination blanket and coat according to the present invention while it is used as a coat.
Figure 3:
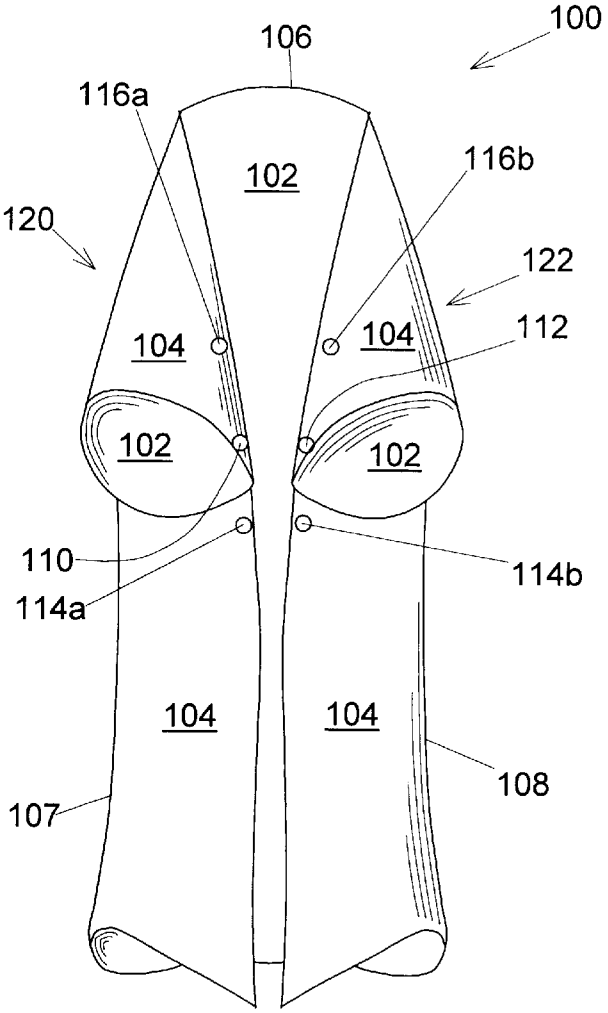
FIG. 3 shows a combination blanket and coat according to the present invention while it is used as a coat.

FIGS. 2, 3, and 4 show conversion of combination blanket and coat 100 from a blanket to a coat. Fasteners 110*a* and 110*b* reversibly connect the upper right corner of the fabric sheet to right edge 107, thereby forming right sleeve 120, as shown in FIG. 2. Similarly, fasteners 112*a* and 112*b* reversibly connect the upper left corner of the fabric sheet to left edge 108, thereby forming left sleeve 122. A user places inner surface 102 against his/her back with top edge 106 against the back of his/her neck, and places his/her arms into sleeves 120 and 122. Edges 107 and 108 are brought forward and around to the front of the user's body, thereby wrapping the user in combination blanket and coat 100, as shown in FIG. 3. Fasteners 114*a* and 114*b* may reversibly connect right edge 107 to left edge 108 while combination blanket and coat 100 is worn as a coat, as shown in FIG. 4. Similarly, fasteners 116*a* and 116*b* may reversibly connect together two points along top edge 106 while combination blanket and coat 100 is worn as a coat. Top edge 106 may alternatively be placed over the user's head, so that reversibly connecting two points along top edge 106 with fasteners 116*a* and 116*b* forms hood 124, as shown in FIG. 4. The dimensions of the fabric sheet may vary considerably, and depend on the stature of the user, although a user of a given stature may wear a combination blanket and coat of varying size.

Figure 5:
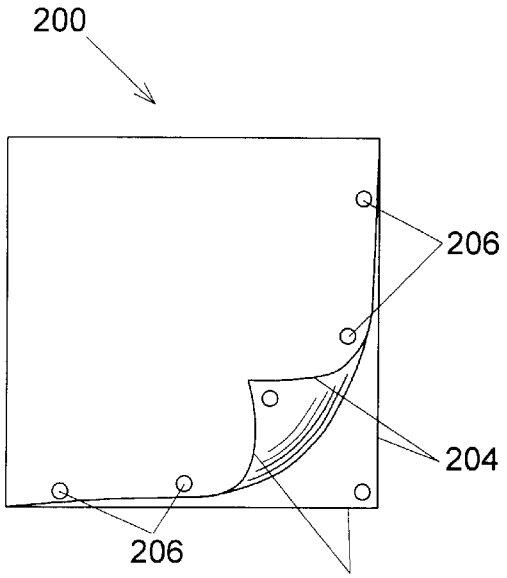
FIG. 5 shows a combination detachable hood and storage bag according to the present invention.
Figure 6:
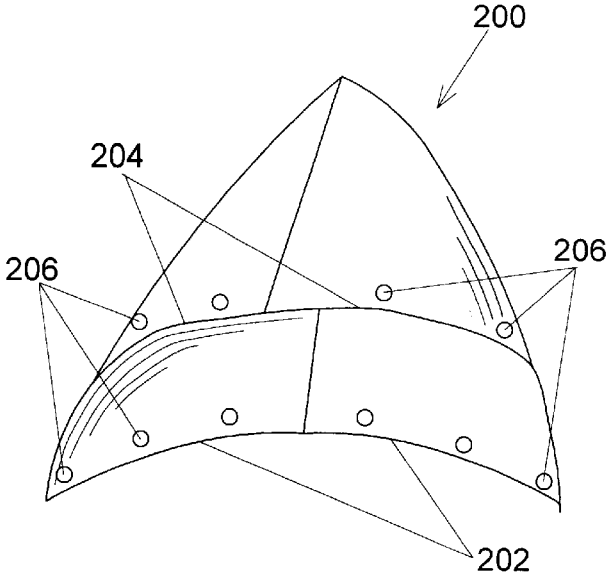
FIG. 6 shows a combination detachable hood and storage bag according to the present invention configured as a hood.
Figure 8:
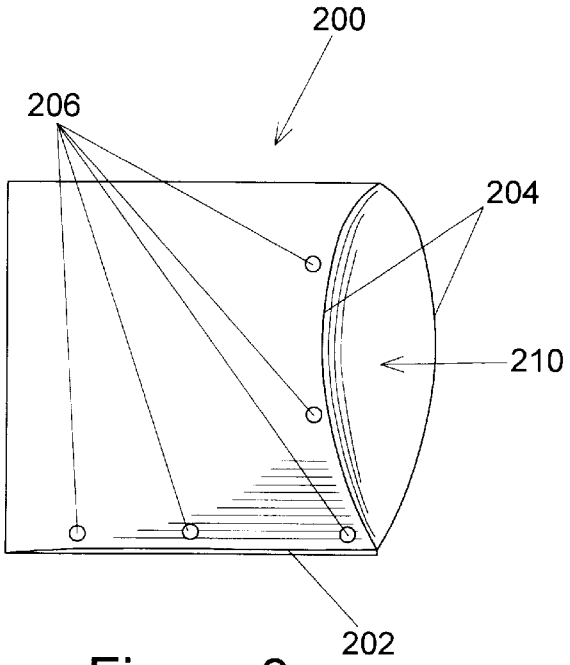
FIG. 8 shows a combination detachable hood and storage bag according to the present invention configured as an open storage bag.
Figure 9:
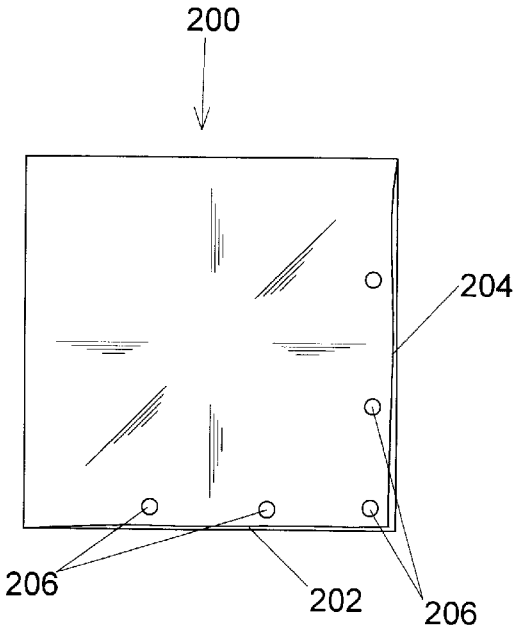
FIG. 9 shows a combination detachable hood and storage bag according to the present invention configured as a closed storage bag.
Figure 7:
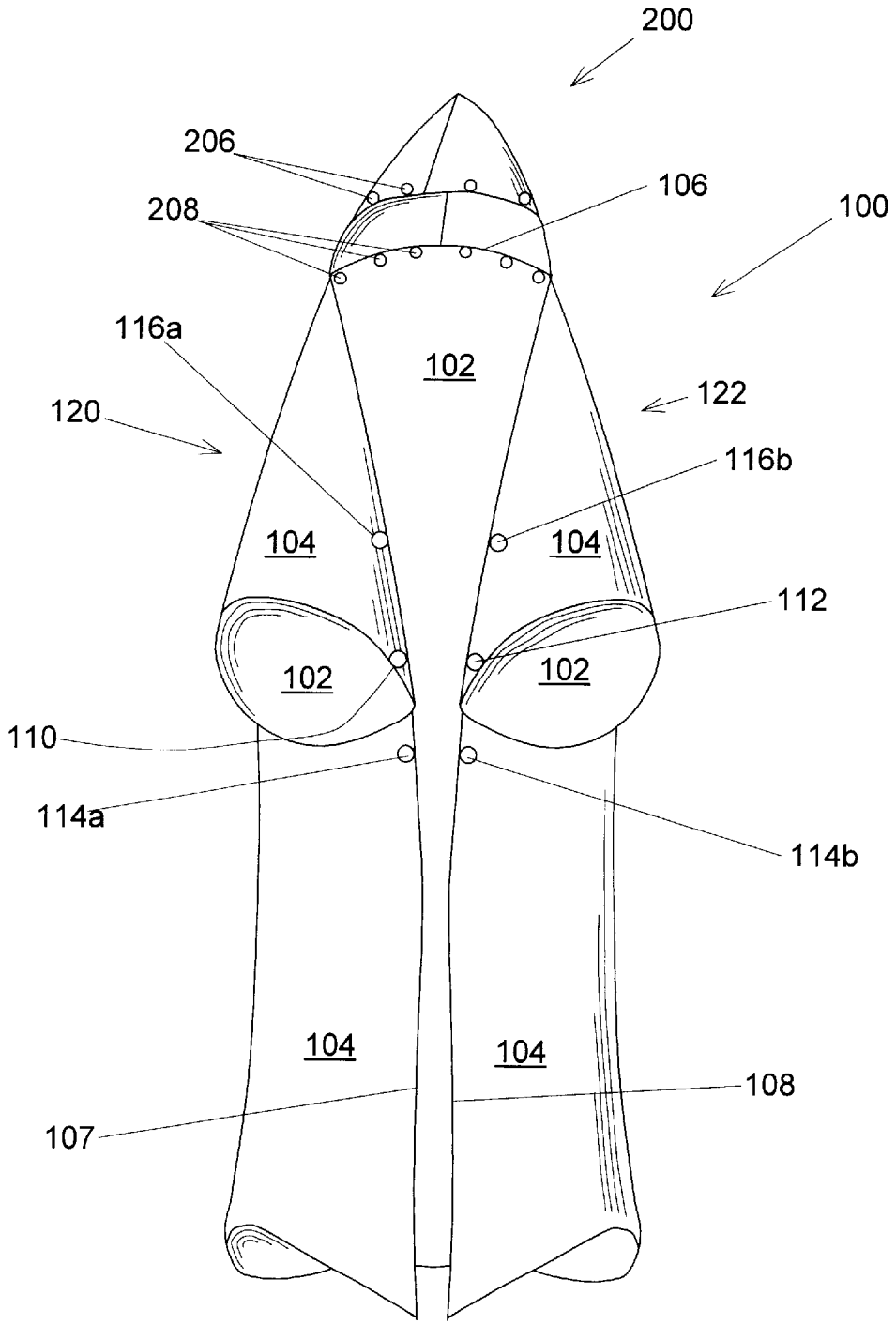
FIG. 7 shows a combination detachable hood and storage bag according to the present invention configured as a hood and connected to a combination blanket and coat according to the present invention.

A preferred embodiment of a detachable hood 200 is shown in FIGS. 5, 6, and 7, and is shown converted to a storage bag for combination blanket and coat 100 in FIGS. 8 and 9. Hood 200 comprises a substantially rectangular pocket of substantially water-resistant material, as shown in FIG. 5. Suitable water-resistant materials have been recited hereinabove. The interior of the pocket may comprise water-resistant material, or any insulating material. Edges 202 and 204 are open. Without departing from inventive concepts disclose and/or claimed herein, a pocket having any suitable shape with two open edges may be employed for the hood. To be used as a hood, edge 202 of the pocket is pulled apart until it is extended substantially linearly, as shown in FIG. 6. Edge 202 may then be reversibly connected in this linear fashion to top edge 106 of combination blanket and coat 100 using fasteners 206 on hood 200 and mating fasteners 208 on top edge 106, as shown in FIG. 7.

When used as a storage bag, hood 200 must first be removed from combination blanket and coat 100. Some of fasteners 206 may be used to reversibly close one of edges 202 or 204, thereby forming a substantially rectangular pocket 210 with one open side. Edge 202 is shown reversibly closed in FIG. 8, while edge 204 is shown as the open side. Combination blanket and coat 100 may be rolled, folded, and/or compressed and inserted into pocket 210, and the open side reversibly closed with remaining fasteners 206, as shown in FIG. 9. Hood 200 therefore provides a convenient storage bag for the combination blanket and coat for carrying and/or storage.

Figure 10:
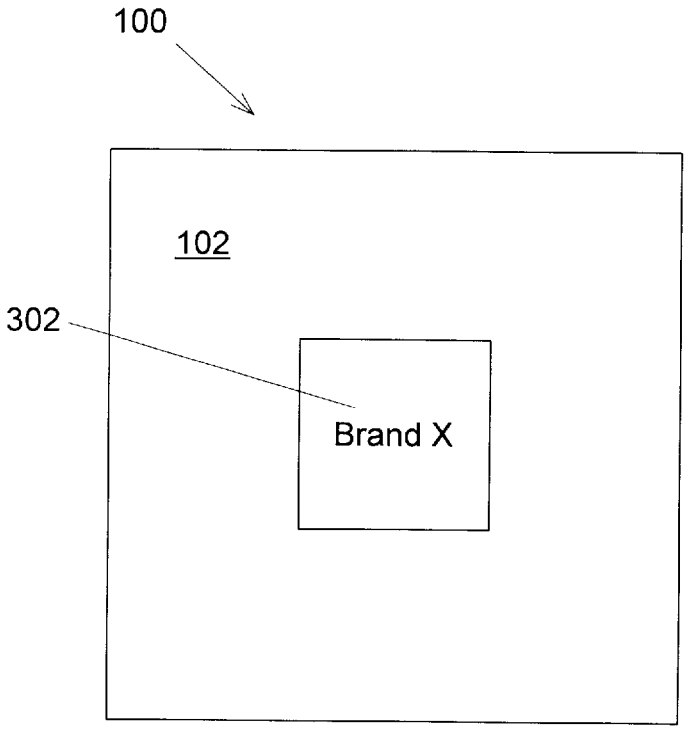
FIG. 10 shows a combination blanket and coat according to the present invention with advertising indicia on the inner surface.
Figure 11:
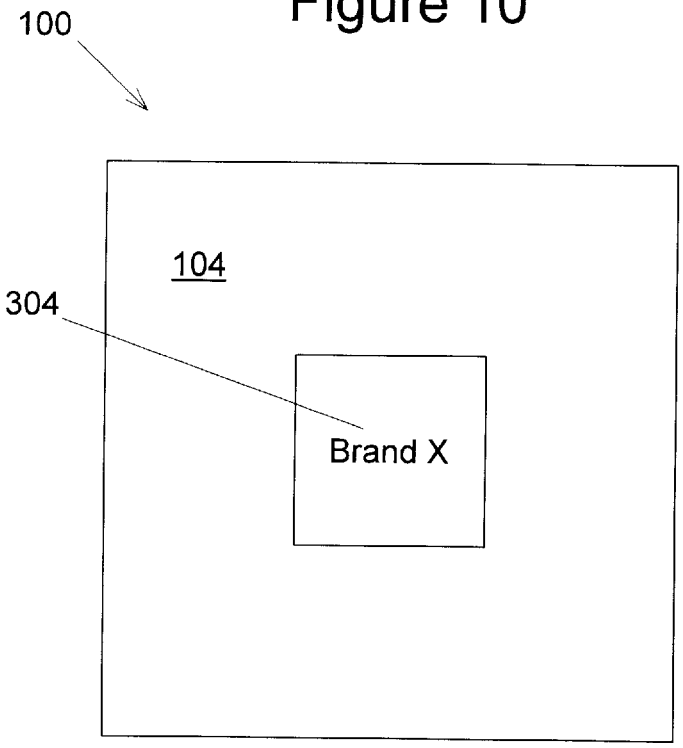
FIG. 11 shows a combination blanket and coat according to the present invention with advertising indicia on the outer surface.

Combination blanket and coat 100 may provide an excellent medium for displaying advertising indicia of various sorts. FIG. 10 shows combination blanket and coat 100 with exemplary advertising indicia 302 on inner surface 102. Advertising indicia 302 would be presented when combination blanket and coat were used as a blanket. FIG. 11 shows combination blanket and coat 100 with exemplary advertising indicia 304 on outer surface 104. Advertising indicia 304 would be presented on the back of a user when combination blanket and coat were used as a coat.

In an alternative embodiment of the present invention, the combination blanket and coat may be provided with one or more pockets on the outer surface. These pockets may be used for storage and/or to keep warm the hands of the user. One or more pockets may also be provided on the inner surface of the combination blanket and coat.

The present invention has been set forth in the form of its preferred and alternative embodiments. It is nevertheless intended that modifications to the disclosed combination blanket and coat may be made without departing from inventive concepts disclosed and/or claimed herein.

What is claimed is:

1. A water-resistant combination blanket and coat, comprising:

a fabric sheet having a top edge, a left edge, a right edge, an inner surface, and an outer surface comprising substantially water-resistant fabric;

a fastener for reversibly connecting a first point on the top edge to the right edge; and a fastener for reversibly connecting a second point on the top edge to the left edge, wherein:

fastening the first point on the top edge to the right edge forms a right sleeve and fastening the second point on the top edge to the left edge forms a left sleeve, thereby allowing a user to wear the combination blanket and coat as a water-resistant coat; and unfastening the first point on the top edge from the right edge and unfastening the second point on the top edge from the left edge allow the user to use the combination blanket and coat as a water-resistant blanket.

2. A water-resistant combination blanket and coat as recited in claim 1, wherein the inner surface comprises an insulating fabric.

3. A water-resistant combination blanket and coat as recited in claim 1, further comprising at least one fastener for reversibly connecting the left edge to the right edge.

4. A water-resistant combination blanket and coat as recited in claim 1, further comprising a fastener for reversibly connecting two points on the top edge of the fabric sheet together, thereby forming a hood.

5. A water-resistant combination blanket and coat as recited in claim 1, further comprising:

a substantially water-resistant detachable hood; and a fastener for reversibly connecting the hood to the top edge of the fabric sheet.

6. A water-resistant combination blanket and coat as recited in claim 5, wherein the hood comprises a hood pocket having two adjacent open sides, and one of the two open sides of the pocket may be pulled apart and reversibly connected to the top edge of the fabric sheet in a linear fashion.

7. A water-resistant combination blanket and coat as recited in claim 6, further comprising:

a fastener for reversibly closing a first side of the two open sides of the hood pocket, thereby forming a storage bag having an open side; and a fastener for reversibly closing the open side of the storage bag, wherein the fabric sheet may be stored within the storage bag.

8. A water-resistant combination blanket and coat as recited in claim 1, further comprising a combination detachable hood and storage bag, the combination detachable hood and storage bag comprising:

a pocket having two adjacent open sides;

a fastener for reversibly closing a first side of the two open sides of the pocket, thereby forming a storage bag having an open side; and a fastener for reversibly closing the open side of the storage bag, wherein:

the fabric sheet may be stored within the storage bag; and one of the two open sides of the pocket may be pulled apart and reversibly connected to the top edge of the fabric sheet in a linear fashion, thereby forming a hood.

9. A water-resistant combination blanket and coat as recited in claim 1, further comprising advertising indicia on at least one of the outer surface and the inner surface of the fabric sheet.

10. A method for using the combination blanket and coat as recited in claim 1 as a blanket, comprising the steps of:

reversibly disconnecting the first point on the top edge from the right edge, reversibly disconnecting the second point on the top edge from the left edge, spreading the fabric sheet with the outer surface on a ground surface, and sitting on the inner surface.

11. A method for using the combination blanket and coat as recited in claim 1 as a coat, comprising the steps of:

reversibly connecting the first point on the top edge to the right edge thereby forming a right sleeve, reversibly connecting the second point on the top edge to the left edge thereby forming a left sleeve, placing the inner surface against a back of a user with the top edge against a neck of the user, placing arms of the user into the right and left sleeves, and bringing the right edge and the left edge forward and in front of the user thereby wrapping the user in the fabric sheet.

12. A method for using the combination blanket and coat as recited in claim 3 as a blanket, comprising the steps of:

reversibly disconnecting the first point on the top edge from the right edge, reversibly disconnecting the second point on the top edge from the left edge, reversibly disconnecting the right edge from the left edge, spreading the fabric sheet with the outer surface on a ground surface, and sitting on the inner surface.

13. A method for using the combination blanket and coat as recited in claim 3 as a coat, comprising the steps of:

reversibly connecting the first point on the top edge to the right edge thereby forming a right sleeve, reversibly connecting the second point on the top edge to the left edge thereby forming a left sleeve, placing the inner surface against a back of a user with the top edge against a neck of the user, placing arms of the user into the right and left sleeves, bringing the right edge and the left edge forward and in front of the user thereby wrapping the user in the fabric sheet, and reversibly connecting the right edge and the left edge.

14. A method for using the combination blanket and coat as recited in claim 4 as a blanket, comprising the steps of:

reversibly disconnecting the first point on the top edge from the right edge, reversibly disconnecting the second point on the top edge from the left edge, reversibly disconnecting the two points on the top edge from one another, spreading the fabric sheet with the outer surface on a ground surface, and sitting on the inner surface.

15. A method for using the combination blanket and coat as recited in claim 4 as a coat, comprising the steps of:

reversibly connecting the first point on the top edge to the right edge thereby forming a right sleeve, reversibly connecting the second point on the top edge to the left edge thereby forming a left sleeve, placing the inner surface against a back of a user with the top edge over a head of the user, placing arms of the user into the right and left sleeves, bringing the right edge and the left edge forward and in front of the user thereby wrapping the user in the fabric sheet, and reversibly connecting the two points on the top edge thereby forming a hood.

16. A method for using the combination blanket and coat as recited in claim 5 as a blanket, comprising the steps of:

reversibly disconnecting the first point on the top edge from the right edge, reversibly disconnecting the second point on the top edge from the left edge, reversibly disconnecting the hood from the top edge, spreading the fabric sheet with the outer surface on a ground surface, and sitting on the inner surface.

17. A method for using the combination blanket and coat as recited in claim 6 as a coat, comprising the steps of:

reversibly connecting the first point on the top edge to the right edge thereby forming a right sleeve, reversibly connecting the second point on the top edge to the left edge thereby forming a left sleeve, reversibly connecting the hood to the top edge in a linear fashion, placing the inner surface against a back of a user with the top edge against a neck of the user, placing arms of the user into the right and left sleeves, and bringing the right edge and the left edge forward and in front of the user thereby wrapping the user in the fabric sheet.

18. A method for using the combination blanket and coat as recited in claim 7 for storage, comprising the steps of:

reversibly disconnecting the hood from the top edge, reversibly closing the first side of the pocket, thereby forming a storage bag, placing the fabric sheet within the storage bag, and reversibly closing the storage bag.

19. A method for using the combination blanket and coat as recited in claim 8 as a blanket, comprising the steps of:

reversibly disconnecting the first point on the top edge from the right edge, reversibly disconnecting the second point on the top edge is from the left edge, reversibly disconnecting the hood from the top edge, spreading the fabric sheet with the outer surface on a ground surface, and sitting on the inner surface.

20. A method for using the combination blanket and coat as recited in claim 8 as a coat, comprising the steps of:

reversibly connecting the first point on the top edge to the right edge thereby forming a right sleeve, reversibly connecting the second point on the top edge to the left edge thereby forming a left sleeve, reversibly connecting the hood to the top edge in a linear fashion, placing the inner surface against a back of a user with the top edge against a neck of the user, placing arms of the user into the right and left sleeves, and bringing the right edge and the left edge forward and in front of the user thereby wrapping the user in the fabric sheet.

21. A method for using the combination blanket and coat as recited in claim 8 for storage, comprising the steps of:

reversibly disconnecting the hood from the top edge, reversibly closing the first side of the pocket, thereby forming a storage bag, placing the fabric sheet within the storage bag, and reversibly closing the storage bag.

* * * * *